US009284667B2

(12) United States Patent
Pai

(10) Patent No.: US 9,284,667 B2
(45) Date of Patent: Mar. 15, 2016

(54) WOVEN FABRIC HAVING FILAMENTS WITH A PENTAGRAM CROSS-SECTION

(71) Applicant: SUNTEX FIBER CO., LTD., Changhwa (TW)

(72) Inventor: Hung-Yu Pai, Changhwa (TW)

(73) Assignee: SUNTEX FIBER CO., LTD., Changhwa (TW)

( * ) Notice: Subject to any disclaimer, the term of this patent is extended or adjusted under 35 U.S.C. 154(b) by 401 days.

(21) Appl. No.: 13/753,773

(22) Filed: Jan. 30, 2013

(65) Prior Publication Data

US 2014/0213134 A1 Jul. 31, 2014

(51) Int. Cl.
*D03D 15/00* (2006.01)

(52) U.S. Cl.
CPC ..... *D03D 15/0083* (2013.01); *D03D 15/0088* (2013.01); *Y10T 442/3114* (2015.04)

(58) Field of Classification Search
CPC ..... D03D 15/0083; D03D 15/0088; Y10T 442/3114
See application file for complete search history.

(56) References Cited

U.S. PATENT DOCUMENTS

| | | | |
|---|---|---|---|
| 2003/0211319 | A1 | 11/2003 | Koehnen et al. |
| 2005/0246842 | A1 | 11/2005 | Jen |
| 2007/0077840 | A1 | 4/2007 | Chen et al. |
| 2009/0136750 | A1 | 5/2009 | Shen et al. |
| 2011/0302689 | A1 | 12/2011 | Tone et al. |

FOREIGN PATENT DOCUMENTS

| | | | |
|---|---|---|---|
| CN | 201588041 | | 9/2010 |
| CN | 201873791 | | 6/2011 |
| CN | 10036948 | C | 1/2012 |
| CN | 102317518 | | 1/2012 |
| CN | 102317518 | A | 1/2012 |
| CN | 202556845 | | 11/2012 |
| JP | H1072738 | | 3/1998 |
| JP | 2005139575 | | 6/2005 |
| JP | 2006233388 | | 9/2006 |
| JP | 2007009369 | | 1/2007 |
| JP | 2010-196213 | A | 9/2010 |
| TW | 200500525 | | 1/2005 |
| WO | WO2014/021013 | A1 | 6/2014 |

OTHER PUBLICATIONS

Japan search report for Japan patent application 2013-084678 issued on Jul. 1, 2014.
The Korean Intellectual Property Office, Notice of Final Refusal for Korean application 10-2013-0039719, issued on Aug. 29, 2014.
Korean search report for Korean application 10-2013-0039719, issued on Aug. 29, 2014.
Foreign Office Action for application No. 10-2013-0039719 filed in Korea, issued on Mar. 26, 2014.
Study on the Morphology and Structure and Properties of High Elongation Modified Polyester Fiber, Synthetic Technology and Application, Sep. 2006, vol. 21, No. 3.
Office Action issue by TIPO, Taiwan for case 102103443 on Jul. 31, 2015.
Office Action issue by SIPO, China for case 201310125948.5 on Sep. 9, 2015.
Search Report by SIPO, China for case 2013101259485 on Aug. 31, 2015.

*Primary Examiner* — Jeremy R Pierce
(74) *Attorney, Agent, or Firm* — Ming Chow; Sinorica, LLC

(57) ABSTRACT

A woven fabric includes a plurality of interlaced multifilament yarns, wherein at least one of the multifilament yarns includes first and second filaments having a pentagram cross-section, and the first and second filaments have a degree of modification between 1.4 and 2.6. The woven fabric has at least one surface calendered so that at least part of the multifilament yarns are compressed and the first and second filaments interlock with one another to retain low air permeability after repeated washing.

6 Claims, 9 Drawing Sheets

WOVEN FABRIC HAVING FILAMENTS WITH A PENTAGRAM CROSS-SECTION

BACKGROUND

1. Technical Field

The present disclosure relates to a woven fabric having filaments with a pentagram cross-section, and more particularly, to a woven fabric having filaments with five projections and recesses to retain low air permeability after repeated washing.

2. Description of Related Arts

The woven fabric used for the outside surface or inside surface of a garment, such as a down jacket or a fake down jacket, is required to have a low air permeability to ensure that the down or the fake down in the garment can be prevented from coming out and that the garment can be deformed to be inflated and deflated in response to the air coming in and out. In order to achieve low air permeability, the conventional techniques are methods of enhancing the weave density of the fabric and calendering the fabric, to compress the filaments, for lessening the inter-yarn gap; for example, the method disclosed in US 2011/0302689.

However, there are fundamental problems with the conventional methods of controlling low air permeability by enhancing the weave density and calendering in that the ability to easily undergo the process is unreliable since yarn breaking may frequently occur and the productivity remains minimal since the weaving speed is relatively slow. Furthermore, even if the woven fabric that is obtained has a low air permeability at the initial state, it is very difficult to maintain the initial low air permeability since the inter-yarn gap is spread out during lapses of time by such forces as bending and expansion/contraction in the daily uses associated with folding, washing, etc. Consequently, down or fake down is likely to dissipate.

SUMMARY

One aspect of the present disclosure provides a woven fabric having filaments with a pentagram cross-section to retain low air permeability after repeated washing.

According to this aspect of the present disclosure, a woven fabric comprising a plurality of interlaced multifilament yarns, wherein at least one of the multifilament yarns comprises first and second filaments having a pentagram cross-section, the first and second filaments have a degree of modification between 1.4 and 2.6, and the woven fabric has at least one surface calendered so that at least part of the multifilament yarns are compressed and the first and second filaments interlock with one another.

Due to the design of the interlocking of the first filament with the second filament adjacent to the first filament, the multifilament yarns of the woven fabric are tightly bound so that the air permeability of the woven fabric is maintained at a very low level even after repeated washing.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic.

Further, repeated use of the phrase "in the embodiment" does not necessarily refer to the same embodiment, although it may.

The present disclosure is directed to a woven fabric having filaments with a pentagram cross-section to retain low air permeability after repeated washing. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
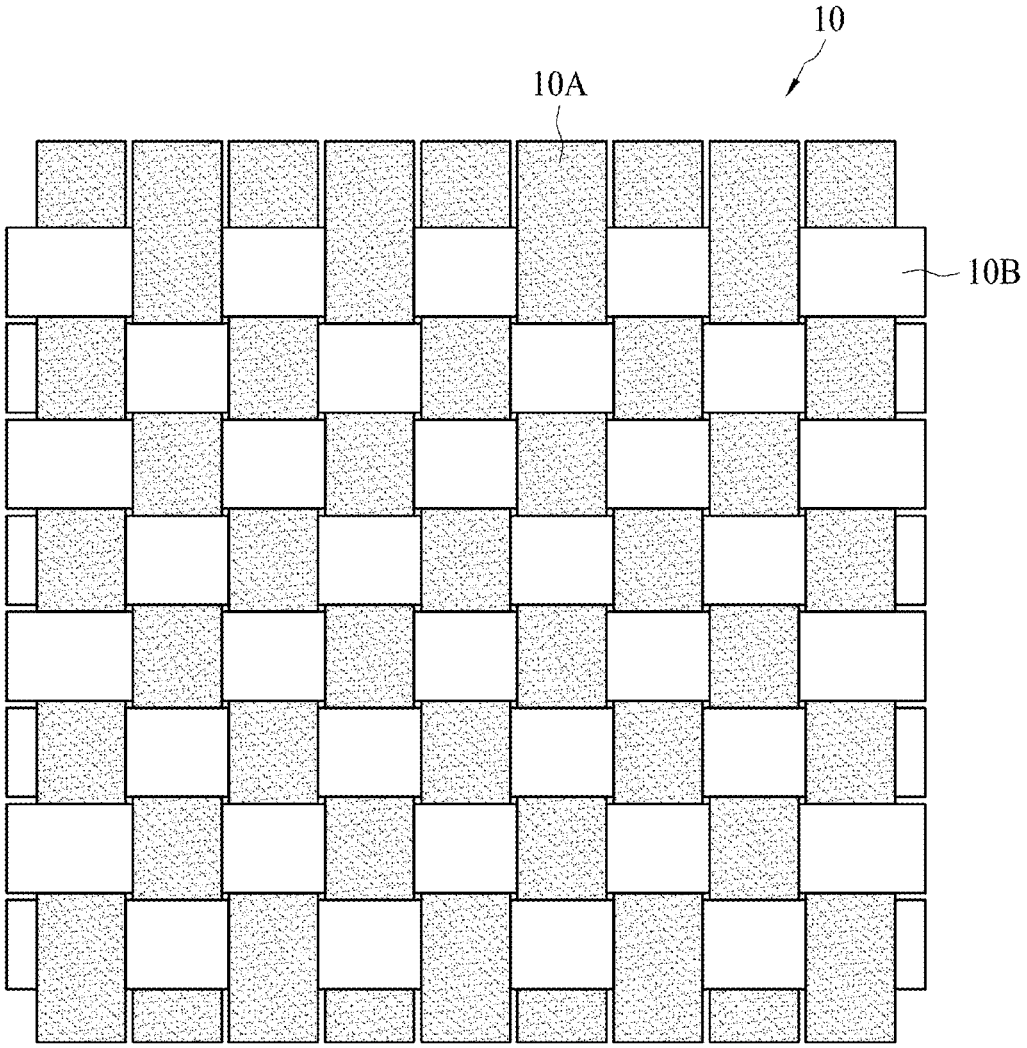
FIG. 1 is a top view of a woven fabric in accordance with embodiments of the invention.

FIG. 1 is a top view of a woven fabric 10 in accordance with embodiments of the invention. In one embodiment of the present disclosure, the woven fabric 10 comprises a plurality of column lines 10A and a plurality of row lines 10B interlaced with the column lines 10A. The column line 10A and the row line 10B are multifilament yarns having a plurality of synthetic filaments. It should be noted that, in addition to the interlacing technique shown in FIG. 1, the woven fabric 10 can be formed of any suitable interlacing techniques, such as plain weave, twill weave and satin weave. In one embodiment of the present disclosure, the woven fabric 10 has a density (warp density or weft density) between 120 and 290 yarns/2.54 cm, and preferably between 130 and 290 yams/2.54 cm.

Figure 2:
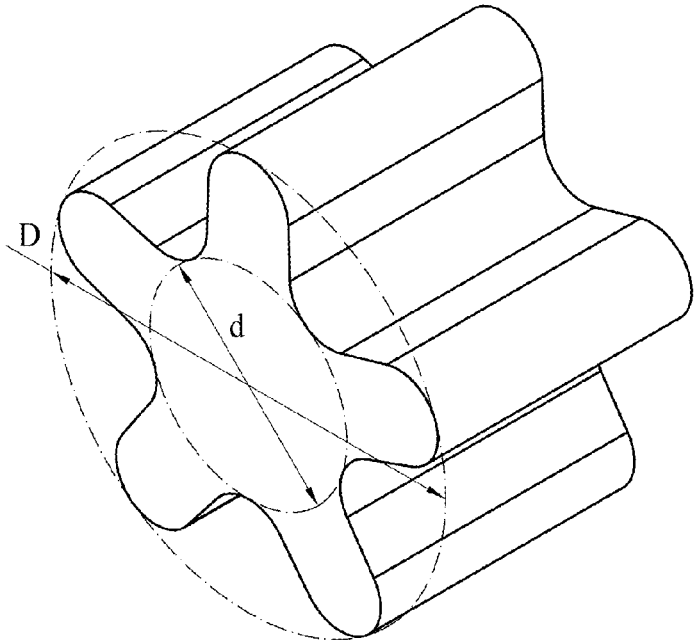
FIG. 2 is a full view of the filament used in the woven fabric of FIG. 1, in accordance with one embodiment of the present disclosure.

FIG. 2 is a full view of the synthetic filament used in the woven fabric 10 of FIG. 1 in accordance with one embodiment of the present disclosure. In one embodiment of the present disclosure, the synthetic filament used in the woven fabric 10 has a pentagram cross-section. The length of the major axis (the longest diameter, D) and the length of the minor axis (the shortest diameter, d) of the cross-section of the pentagram filament can be measured at predetermined magnifications when using a microscope, and the ratio of the length of the major axis (D) to the length of the minor axis (d) of the cross-section of the pentagram filament can then be calculated. The average of the ratios of several filaments is defined as the degree of modification. In one embodiment of the present disclosure, the pentagram filaments have a degree of modification between 1.4 and 2.6, and preferably the pentagram filaments have a modification between 1.4 and 2.0.

Several multifilament yarns measuring 10,000 meters in length are prepared. The mass (g) of each of the multifilament yarns is measured to determine an average of the multifilament yarns, and the average is defined as the fineness (total fineness) of the multifilament yarns. In one embodiment of the present disclosure, the multifilament yarn has a fineness between 5.5 and 79.0 dtex, preferably between 7.7 and 44.0 dtex. In one embodiment of the present disclosure, the multifilament yarns with 20 pentagram filaments have a fineness of 22 dtex. The fineness of the pentagram filament of the multifilament yarns is determined by dividing the fineness of the multifilament yarns by the number of filaments. In one embodiment of the present disclosure, the pentagram filament has a fineness of 1.1 dtex.

Figure 3:
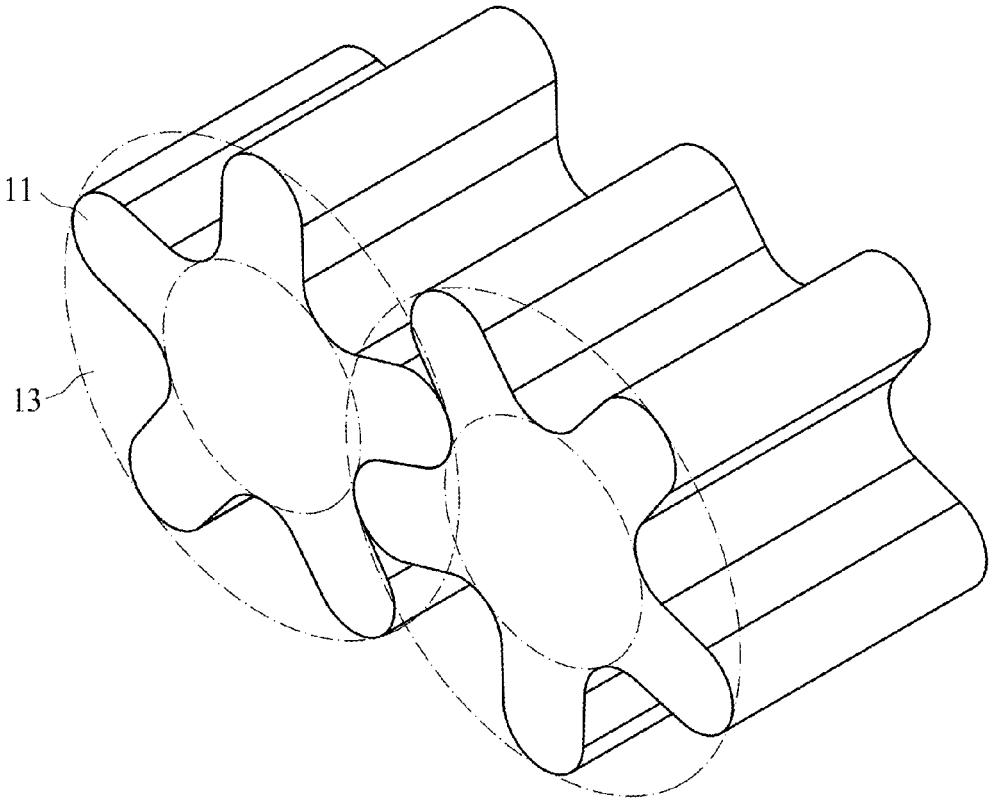
FIG. 3 is a full view of two filaments used in the woven fabric of FIG. 1, in accordance with one embodiment of the present disclosure.

FIG. 3 is a full view of two adjacent filaments used in the woven fabric 10 of FIG. 1 in accordance with one embodiment of the present disclosure. In one embodiment of the present disclosure, each filament has five projections 11, and at least one of the projections 11 of the filament is wedged between two of the projections 11 of the adjacent filament. In a preferred embodiment of the present disclosure, each filament has five recesses 13 between the projections 11, and at least one of the projections 11 of the filament is inserted into one of recesses of the adjacent filament.

Figure 4:
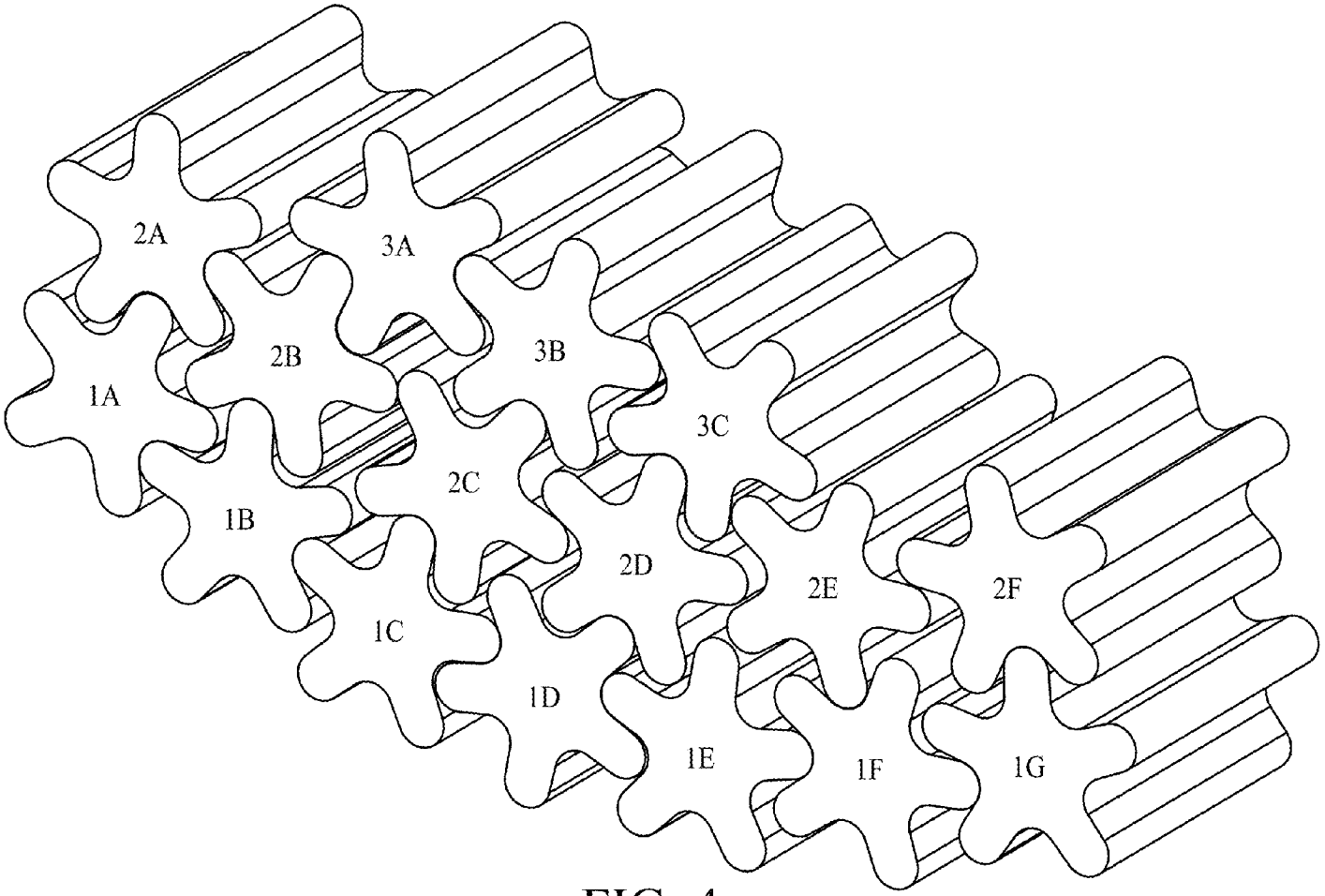
FIG. 4 is a schematic view showing one of the multifilament yarns of the woven fabric before the calendering process in FIG. 1, in accordance with one embodiment of the present disclosure.

FIG. 4 is a schematic view showing one of the multifilament yarns of the woven fabric 10 in FIG. 1, in accordance with one embodiment of the present disclosure. In one embodiment of the present invention, the multifilament yarns comprise a plurality of filaments 1A-1G in a first layer, a plurality of filaments 2A-2F in a second layer on the first layer, and a plurality of filaments 3A-3C in a third layer on the second layer. When referring to FIG. 4, in one embodiment of the present disclosure, the multifilament yarns comprise three filaments 1B, 2A, 3A adjacent to the filament 2B, and the three filaments 1B, 2A, 3A interlock with the filament 2B; the multifilament yarns comprise four filaments 1D, 2C, 2E, 3C adjacent to the filament 2D, and the four filaments 1D, 2C, 2E, 3C interlock with the filament 2D.

In a preferred embodiment of the invention, the movement of the pentagram filament is restricted by at least one laterally adjacent filament and one vertically adjacent filament. For example, the filament 1C is laterally adjacent to the filament 1B and vertically adjacent to the filament 2C, wherein one of the five projections of the filament 1C is wedged between two of the projections of the filament 1B, and another one of the five projections of the filament 1C is wedged between two of the projections of the filament 2C. In addition, one of the five projections of the filament 1C is wedged between two of the projections of the filament 1D, and one of the five projections of the filament 1D is wedged between two of the projections of the filament 1C.

For two laterally adjacent filaments 1B and 1C, the wedging of the projection of the filament 1C between two projections of the adjacent filament 1B not only restricts the vertical movement but also the lateral movement of the filament 1C. Similarly, for two vertically adjacent filaments 1C and 2C, the wedging of the projection of the filament 1C between two projections of the adjacent filament 2C not only restricts the vertical movement but also the lateral movement of the filament 1C. Consequently, the movement of the pentagram filaments in the multifilament yarns is restricted. If the filament has at least three of the projections wedged between three of the projections of the adjacent filaments, the movement of the pentagram filaments in the multifilament yarns is further restricted.

Figure 5:
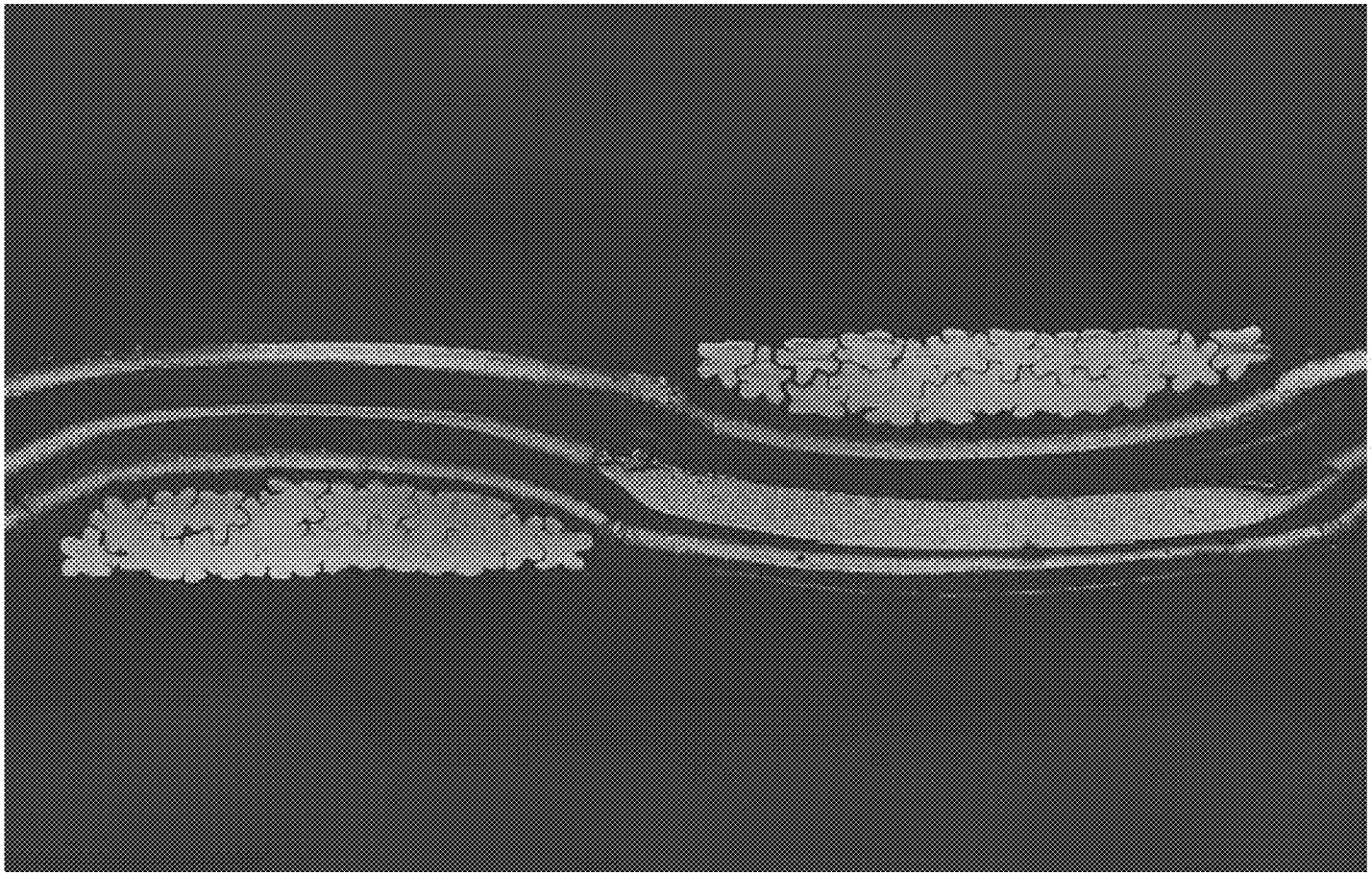
FIG. 5 is an SEM image showing the multifilament yarns of the woven fabric after the calendering process, in accordance with one embodiment of the present disclosure.
Figure 6:
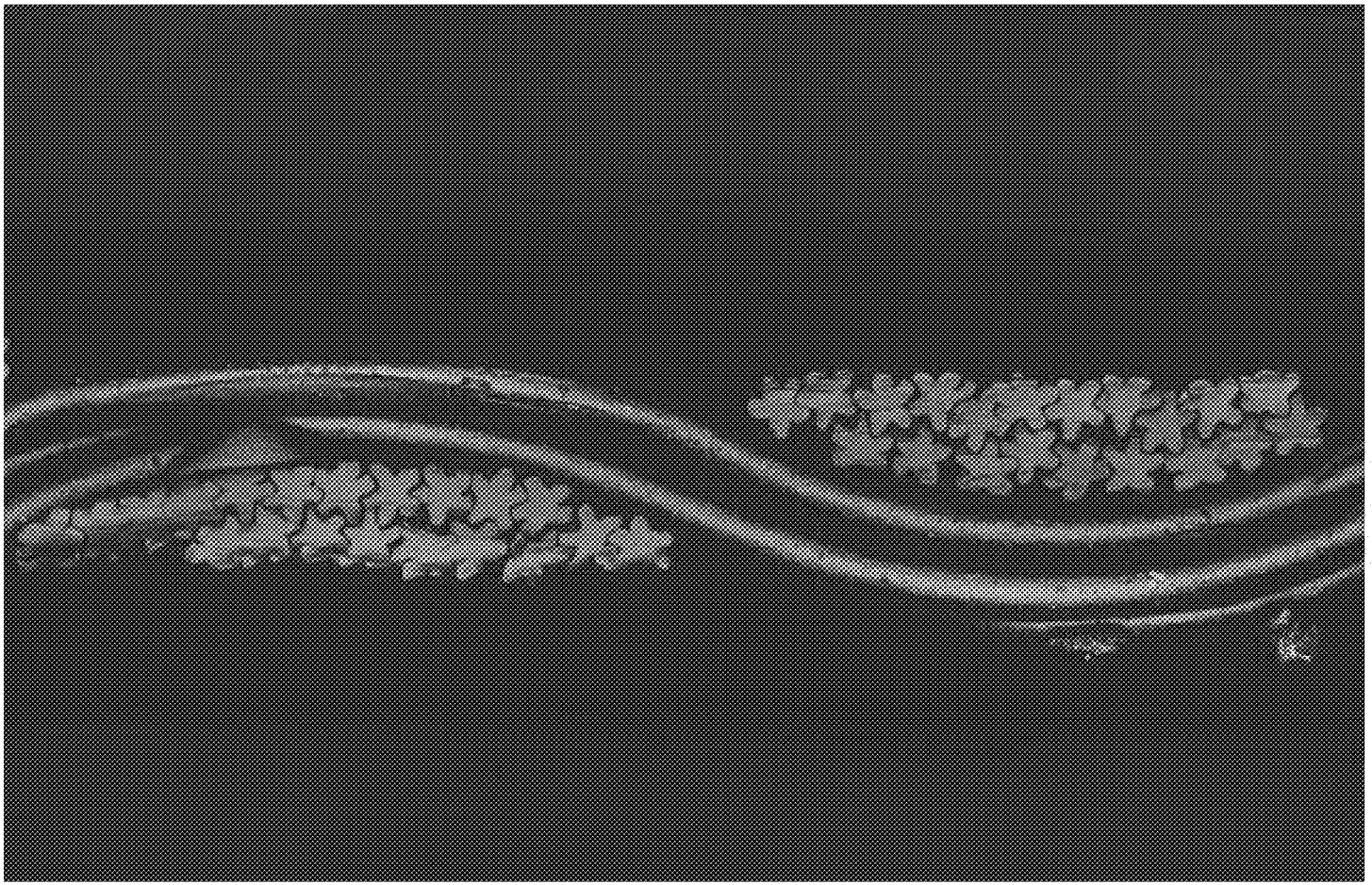
FIG. 6 is an SEM image showing the multifilament yarns of the calendered woven fabric after being washed 50 times, in accordance with one embodiment of the present disclosure.
Figure 7:
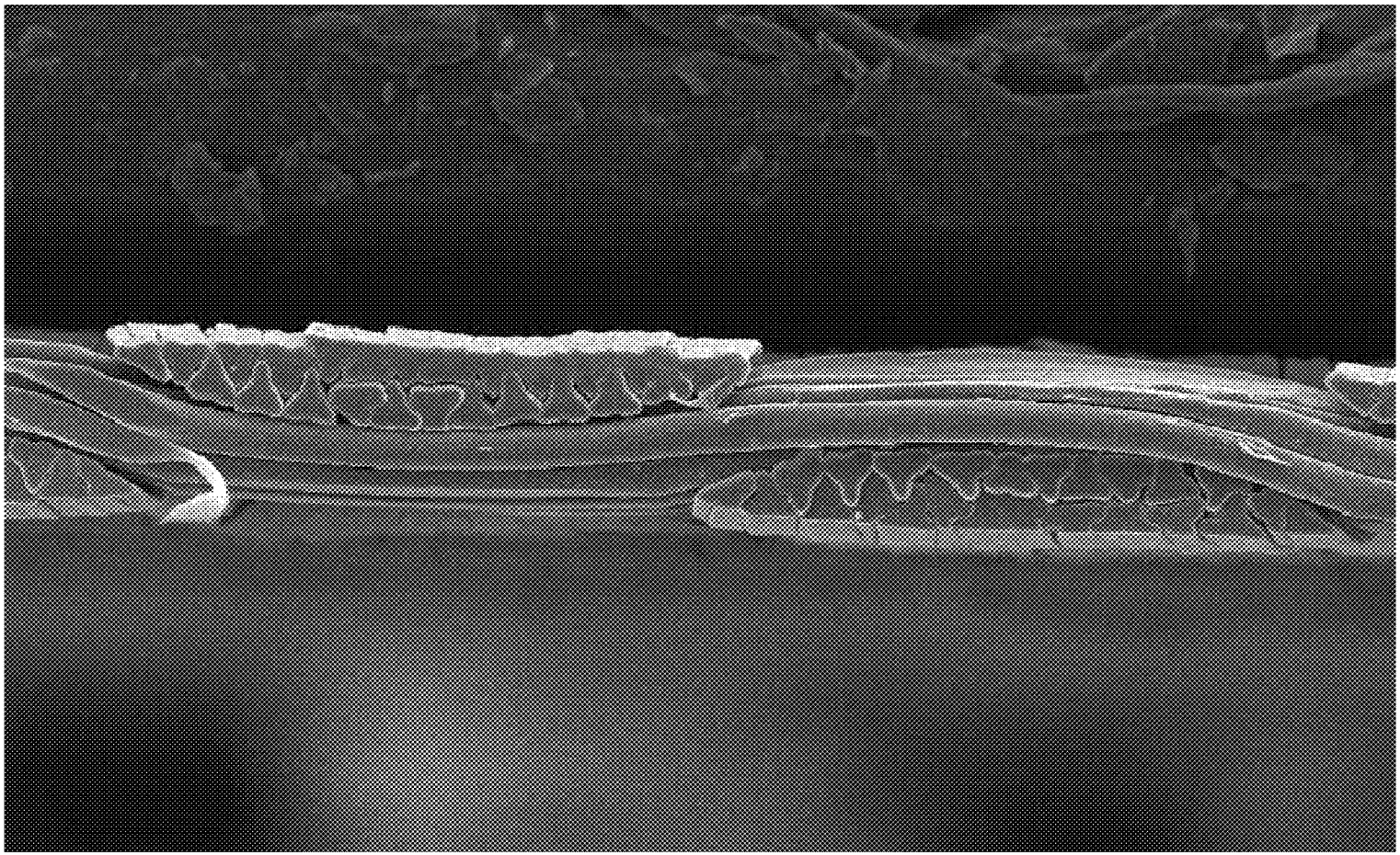
FIG. 7 is an SEM image showing the multifilament yarns with a Y-shaped filament cross-section of the comparative woven fabric after the calendering process.
Figure 8:
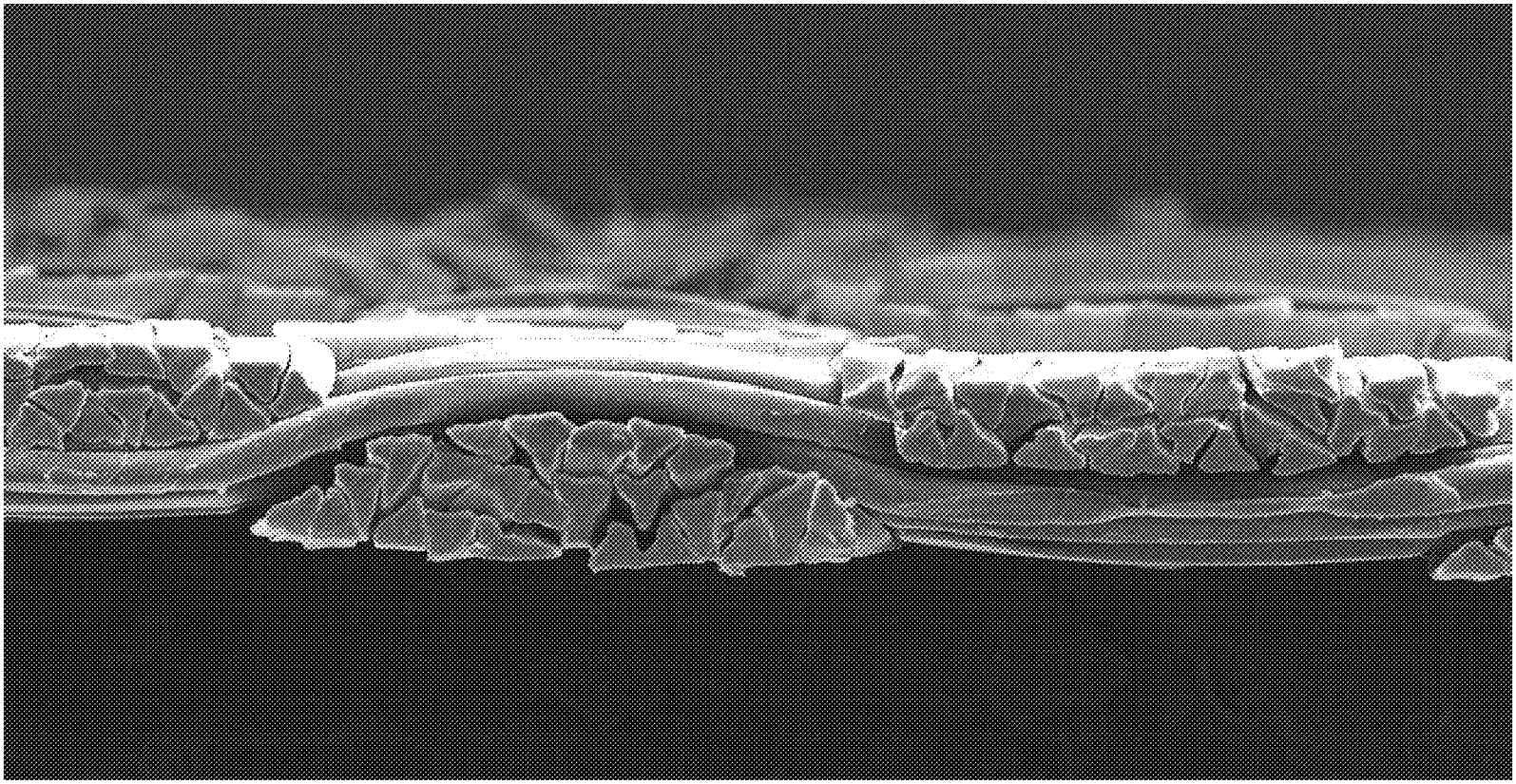
FIG. 8 is an SEM image showing the multifilament yarns with a Y-shaped filament cross-section of the calendered comparative woven fabric after being washed 50 times.
Figure 9:
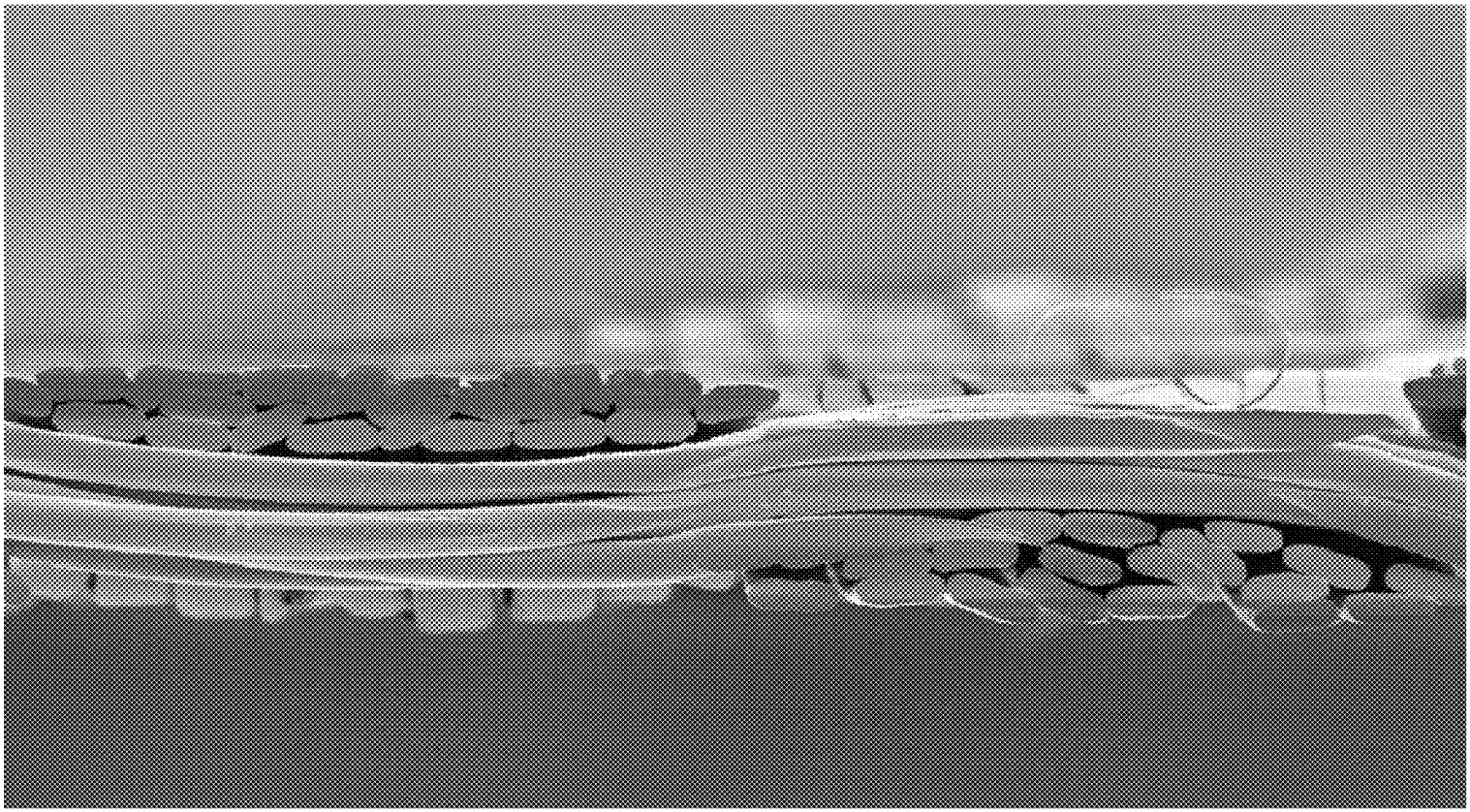
FIG. 9 is an SEM image showing the multifilament yarns with a linear filament cross-section of the comparative woven fabric after the calendering process.
Figure 10:
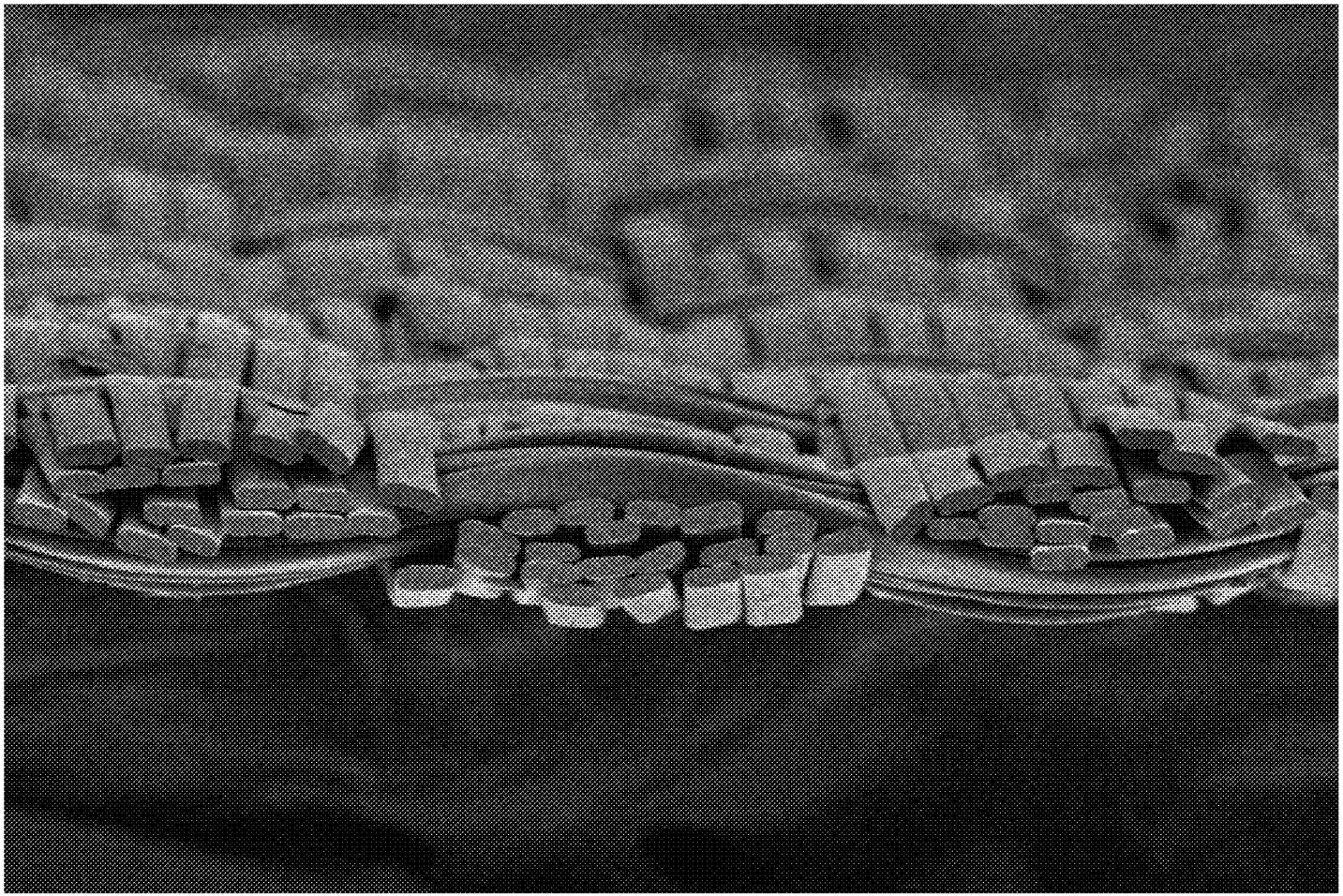
FIG. 10 is an SEM image showing the multifilament yarns with a linear filament cross-section of the calendered comparative woven fabric after being washed 50 times.

FIG. 5 is an SEM (scanning electron microscope) image showing the multifilament yarns of the woven fabric 10 after the calendering process in accordance with one embodiment of the present disclosure, and FIG. 6 is an SEM image showing the multifilament yarns of the calendered woven fabric 10 after being washed 50 times, in accordance with one embodiment of the present disclosure. The woven fabric after weaving is generally scoured, relaxed, preset, dyed, and subjected to final processing by using processing machines typically used for creating thin woven fabrics. In one embodiment of the present invention, the woven fabric 10 has at least one surface calendered so that at least part of the multifilament yarns are compressed and the filaments interlock with one another.

By subjecting the woven fabric to calendering, the pentagram filaments of the multifilament yarns are compressed and fixed in a state where the pentagram filaments overlap one another in at least part of the multifilaments. In one embodiment of the present invention, the temperature of calendering is not particularly limited, but is preferably higher than the glass transition temperature of the raw material used to prepare the pentagram filaments, but lower than the melting point of the raw material.

The pressure of the calendering is designed such that the convex surfaces of pentagram filaments on the upper side of the woven fabric substantially become flat. In one embodiment of the present disclosure, the calendering process of the woven fabric can be implemented by using one of two rolls. After the calendering process, the multifilament yarns of the woven fabric 10 are tightly bound so that the air permeability of the woven fabric 10 is very low even after repeated washing.

In the present disclosure, the air permeability test method specified in JIS 1096 8.26.1A is used to objectively evaluate the air permeability of the exemplary woven fabric shown in FIGS. 5-6, according to the present invention and the comparative woven fabrics shown in FIGS. 7-10. The following table summarizes the testing results of the exemplary woven fabric and the comparative woven fabrics.

| | | | | |
|---|---|---|---|---|
| Filament | Shape of cross-section | Pentagram | Y-shaped | Linear |
| | Degree of modification | 1.928 | 1.941 | 3.408 |
| | Fineness (dtex) | 1.1 | 0.916 | 1.1 |
| Multifilament | Number of filament | 20 | 24 | 20 |
| | Fineness (dtex) | 22 | 22 | 22 |
| Woven fabric | Weave | Plain | Plain | Plain |
| | Calendering | One side | One side | One side |
| | Finishing density Weft | 158 | 160 | 158 |
| | Finishing density Warp | 204 | 203 | 204 |
| | Initial air permeability ($cm^3/cm^2/s$) | 0.5 | 0.6 | 0.4 |
| | Air permeability after 10 washing cycles ($cm^3/cm^2/s$) | 0.5 | 0.6 | 1.5 |
| | Air permeability after 20 washing cycles ($cm^3/cm^2/s$) | 0.6 | 0.8 | 1.9 |
| | Air permeability after 50 washing cycles ($cm^3/cm^2/s$) | 0.7 | 1.3 | 2.0 |

As clearly shown in the table, the initial air permeability of the exemplary woven fabric and the comparative woven fabrics are substantially at the same level. However, after being washed 50 times, the air permeability of the comparative woven fabrics increases dramatically by twofold for the Y-shaped filament and fivefold for the liner filament, while the air permeability of the exemplary woven fabric is substantially maintained at the same level as the initial air permeability. Obviously, the multifilament yarns of the woven fabric are tightly bound by the pentagram cross-section of the filaments so that the air permeability of the woven fabric is maintained at a very low level even after repeated washing.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A woven fabric, comprising a plurality of interlaced multifilament yarns, at least one of the plurality of interlaced multifilament yarns comprising a plurality of filaments, the plurality of filaments interlocking to each other, a movement of the plurality of filaments being restricted by at least one laterally adjacent filament and one vertically adjacent filament of the plurality of filaments; each of the plurality of interlaced multifilament yarns having a pentagram cross-section and a degree of modification between 1.4 and 2.0; and the woven fabric having at least one surface calendered so that at least a part of the multifilament yarns is compressed.

2. The woven fabric of claim 1, wherein the woven fabric has an air permeability of 0.5 $cc/cm^2/s$ or less after being washed 10 times, 0.6 $cc/cm^2/s$ or less after being washed 20 times, or 0.7 $cc/cm^2/s$ or less after being washed 50 times.

3. The woven fabric of claim 1, wherein each of the plurality of filaments has five projections, at least one projection of a first filament is wedged between two projections of a second filament adjacent to the first filament, and at least one projection of the second filament is wedged between two projections of the first filament.

4. The woven fabric of claim 1, wherein the multifilament yarn has a fineness between 5.5 and 79.0 dtex.

5. The woven fabric of claim 4, wherein the multifilament yarn has a fineness between 7.7 and 44.0 dtex.

6. The woven fabric of claim 1, having a density between 130 and 290 yarns/2.54 cm.

* * * * *